United States Patent [19]

Tang

[11] 4,120,157

[45] Oct. 17, 1978

[54] POWER GENERATING AND AIR CONDITIONING SYSTEM UTILIZING WASTE HEAT

[76] Inventor: Mou-Lin Tang, No. 18-3, Alley 133, Lane 100, Tung Yuan St., Taipei, Taiwan

[21] Appl. No.: 773,479

[22] Filed: Mar. 2, 1977

[51] Int. Cl.[2] ..... F01K 23/10

[52] U.S. Cl. ..... 60/618; 62/467 PR

[58] Field of Search ..... 60/616, 618; 62/323, 62/467 PR

[56] References Cited

U.S. PATENT DOCUMENTS

| | | | |
|---|---|---|---|
| 3,228,189 | 1/1966 | Baker | 60/618 |
| 3,888,084 | 6/1975 | Hawkins | 60/618 |
| 3,945,210 | 3/1976 | Chapin | 60/618 |
| 4,031,705 | 6/1977 | Berg | 60/618 |

*Primary Examiner*—Louis J. Casaregola

*Attorney, Agent, or Firm*—Burns, Doane, Swecker & Mathis

[57] ABSTRACT

Power generating and air conditioning system comprises an internal combustion engine, a vapor engine, and a refrigerant cooled air conditioning system wherein the vapor engine is driven by the expansion gas of refrigerant, the waste heat of the internal combustion engine is exchanged through a heat exchanger with the refrigerant, such as freon, and the pressure is accumulated to a working pressure, then introduced into the refrigerant engine to expand and drive the rotor to generate power. After the work is done, the larger part of the refrigerant gas is reintroduced through a receiver, to the heat exchanger to absorb heat and accumulate pressure. The remainder of the refrigerant gas is bypassed is condensed in a condenser, and evaporated in an evaporator to produce a cooling effect. After evaporation the bypassed refrigerant is pumped back to the receiver to be incorporated with the larger part of the refrigerant and returned to the heat exchanger for recycling to generate power as well as produce an air conditioning effect. Thus, energy is saved and engine efficiency is increased. The system includes one refrigerant circuit for power generating and one refrigerant circuit for cooling. The later circuit forms a bypass from the low pressure refrigerant gas discharge side of the vapor engine of the former circuit to the low pressure side of the heat exchanger. At least two pressure accumulating chambers for refrigerant are provided within the heat exchanger for utilizing waste heat of the internal combustion engine and each accumulator is provided with a check valve at its inlet and a pressure release valve at its outlet to maintain a stable working pressure. The plurality of accumulating chamber are used alternately in sequence to discharge the refrigerant gas to the vapor engine in substantially steady flow.

7 Claims, 1 Drawing Figure

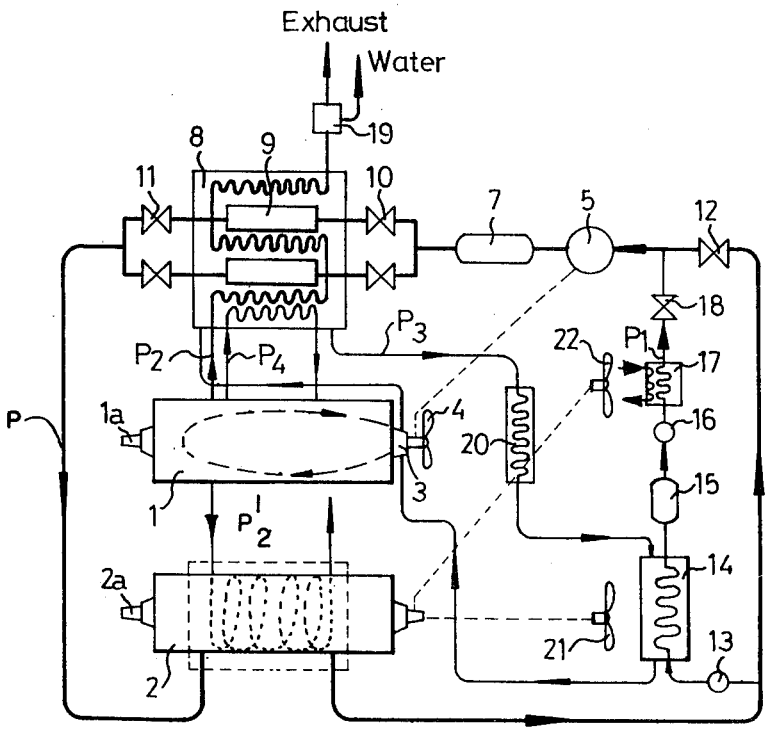
Exhaust
Water
19
8
9
11
10
7
5
12
18
P3
P2
P4
22
P1
17
P
1a
4
20
16
3
15
1
P'2
14
2a
21
13
2

POWER GENERATING AND AIR CONDITIONING SYSTEM UTILIZING WASTE HEAT

FIELD OF INVENTION

The present invention relates generally to power generating and air conditioning system utilizing waste heat, and more particularly to a power generating and air conditioning system comprising an internal combustion engine, a vapor engine and a refrigerant circuit system, wherein the vapor engine is a refrigerant engine. The waste heat energy is exchanged with the refrigerant. The pressure is accumulated to a certain work pressure, then released and introduced into the refrigerant engine to generate power. The main part of the refrigerant gas is returned to the heat exchanger. The remainder of the refrigerant gas is condensed through bypass and evaporated to produce cooling effect, then incorporated into the main part to the heat exchanger so that it is recycled and reused to enable the vapor engine to generate power as well as produce a cooling effect for air conditioning.

BACKGROUND OF INVENTION

As a result of oil crisis, scientists all over the world have endeavored to find new energy resources to substitute for oil. However, it is a long range effort. Until such substitutes are found, oil and petroleum fueled engine will still play an important roll in the industrial power field. Therefore, methods of reducing consumption of oil and improving the efficiency of the existing power machinery are still important.

It is well known that waste heat is discharged to the atmosphere in quite considerable amount. If it can be well utilized, energy will be saved and efficiency increased. The inventor has devoted himself in this respect and found a way to generate power and in the meantime to produce a cooling effect for air conditioning through heat exchange and pressure accumulation of the refrigerant to recover the waste heat evolved therefrom.

SUMMARY OF INVENTION

Therefore, the main object of the present invention is to provide a novel power generating and air conditioning system comprising an internal combustion engine, a vapor engine and a refrigerant circuit system, wherein the power of the vapor engine is generated through utilizing the waste heat of the internal combustion engine by exchanging heat with the refrigerant and accumulating the pressure of the refrigerant to a certain working pressure. The pressurized refrigerant is then discharged alternately to drive the rotor of the vapor engine. In the meantime, cooling for the internal combustion engine or a cooling effect provided for a car or room is accomplished by the heat absorption through evaporation of the refrigerant. The mutual utilization of waste heat by the two engines would make saving of energy possible.

Another object of the present invention is to provide a power generating and air conditioning system, wherein the refrigerant recycling circuits comprise one circuit of power generation and one circuit of air conditioning. The latter is a bypass from the low pressure outlet side of the vapor engine and incorporated with the former before entering the receiver.

Still another object of the present invention is to provide a power generating and air conditioning system wherein a plurality of heating and pressure accumulating chambers in parallel are provided in the heat exchanger, of which the inlet and outlet are provided respectively with check valve and pressure release valve. When the refrigerent therein is heated up and reaches a desired working pressure, it is discharged to drive the vapor engine.

Other objects and featues of the present invention will become apparent from the following detailed description to be taken in conjunction with the annexed drawings.

BRIEF DESCRIPTION OF DRAWING

The annexed drawing depicts a circuit diagram of the power generating and air conditioning system of the present invention.

DETAILED DESCRIPTION OF EMBODIMENT

Now referring to the drawing, the internal combustion engine 1 can be an engine using gasoline, diesel, heavy oil or other fuel. The vapor engine 2 is a Rankine engine of which the turbine or rotor is driven by means of the high temperature high pressure expansion gas of the refrigerant. Engines 1 and 2 have respective output shafts 1a, 2a for transmitting the power generated to perform work. The internal combustion engine drives a cooling water circulating pump 3, with a radiator fan 4; a refrigerant pump 5 is also driven by the internal combustion engine through adequate transmission. A receiver 7 serves to receive the refrigerant. Heat exchanger 8 comprises at least two heat adsorbing and pressure accumulating chambers 9 being paralleled to connect between the receiver 7 and the vapor engine 2. At low pressure side, the inlet of each accumulator 9 is provided with a check valve 10 and at the high pressure side, the outlet with a pressure release valve 11. A check valve 12 is disposed at the inlet side of the refrigerant pump 5. Thereby a power generating circuit is formed by pipeline P through abovesaid vapor engine 2 - check valve 12 - refrigerant pump 5 - receiver 7 - checkvalve 10 - accumulator 9 - release valve 11 - vapor engine 2.

A bypass $P_1$ is bifurcated from the piping P at the low pressure refrigerant gas outlet side of the refrigerant engine 2 to the inlet side of the refrigerant pump 5. Along with the flowing direction of the refrigerant, in pipeline $P_1$, flow control valve 13, condenser 14, liquid storage 15, expansion valve 16, evaporator 17 and check valve 18 are successively disposed. A refrigerant circuit for air conditioning is formed by the vapor engine 2 - flow control valve 13 — condenser 14 — liquid storage 15 — expansion valve 16 — evaporator 17 — check valve 18 — refrigerant pump 5 — receiver 7 — check valve 10 — accumulator 9 — release valve 11 — refrigerant engine 2.

Exhaust gas from the internal combustion engine 1 having a considerable amount of waste heat is led into the heat exchanger 8 to exchange heat with the refrigerant in the pressure accumulating chamber 9 through exhaust pipe $P_2$. After that, the exhaust gas is separated into gas and water by the separator 19 and discharged to the atmosphere. The cooling water of the internal combustion engine 1 after absorbing heat from the engine, is introduced into the heat exchanger 8 through line $P_3$ to exchange heat with the refrigerant to sufficiently utilize the waste heat and increase the efficiency of heat exchange. The cooling water is pumped into the internal combustion engine 1 by pump 3 to cool down the engine, then introduced into heat exchanger 8, and returns to pump 3 for recycling. The cooling circuit $P_3$ as mentioned here is in the form of water-cooling; if air-cooling is adopted, then this circuit $P_3$ will be deleted. For the sufficient utilization of heat, lubrication oil pipe $P_4$ may be led out from the engine 1 and after heat exchange in the exchanger 8, returned to the engine 1 to increase the heat exchange effect. A part of the waste gas may be introduced to the outside of vapor engine 2 through line $P_2$ before exhausting to keep the engine warm to increase the engine efficiency. A fan 21 driven by the engine 2 may be installed before condenser 14 to increase condensing efficiency. In addition, a fan 22 is installed in front of the evaporator to promote the cooling effect.

The working principle of the present invention is that, after the starting up of the internal combustion engine 1, the cooling water pump 3, fan 4 and refrigerant pump 5 rotate, refrigerant in the refrigerating circuit and water in the cooling circuit start circulation in respective circuits and drive the vapor engine 2. Once the vapor engine 2 starts operation, the power output drives the fans 21 and 22 and may also be used for other purposes.

The power generating process starts when the low temperature low pressure refrigerant discharges from vapor engine 2, passing through pump 5, to receiver 7 then divided through check valves 10 into the accumulating chambers 9 of heat exchanger 8 for heat exchange. The said exchange 8 receives exhaust gas with waste heat, cooling water, and lubricating oil. After entering heat exchanger 8 through check valve 10, the refrigerant is sealed between check valve 10 and pressure release valve 11 to absorb heat and the temperature and pressure are both increased. When exposed to a preset working pressure, pressure release valves 11 open automatically to outlet the high temperature high pressure refrigerant gas into vapor engine 2 and the gas expands to drive the turbine or rotor of engine 2. The refrigerant gas exits from the vapor engine 2 passing through main pipeline P delivered to receiver 7 by pump 5, then to pressure accumulating chamber 9 ready for work of the second cycle. Another part of refrigerant passes through bypass pipeline $P_1$, and flow control valve 13, flows into condenser 14 to condense into liquid form, then through liquid storage 15, expansion valve 16, and into evaporator 17 to evaporate and absorb heat. After evaporation, the low temperature low pressure refrigerant again returns to incorporate into the main line P with the aforementioned refrigerant directly exiting from the vapor engine 2, delivered into receiver 7 for reuse.

In the abovesaid working cycle, the refrigerant in receiver 7 is controlled through the bifurcated lines and valves 10 and 11 to enter into the pressure accumulating chambers 9 of heat exchanger 8 alternately for absorbing heat and accumulating pressure until the working pressure is built up, and then released alternately into the vapor engine 2 to perform work. For this reason, a plurality of refrigerant line may be provided to lead into the heat exchanger 8 and release to drive vapor engine 2 to increase efficiency. In this case, each control valves 10 and 11, may be controlled by interlocking means electrically or mechanically. As this is a well known art, it shall not be further discussed here. Further, when the fan 4 rotates, air is sucked in to furnish air cooling for the radiator 20. Fan 21 serves for air cooling of the condenser 14, and fan 22 for promoting cooling cycle through blowing ahead of cooled medium from evaporator 17. During the cycling of the refrigerant, the waste heat from internal combustion engine 1 exchanges heat with refrigerant through pipeline $P_2$, cooling water pipes $P_3$ and lubrication oil line $P_4$.

In the above embodiment, the waste heat source is from an internal combustion engine; alternative heat sources such as the earth, steam, and solar energy are also feasible. The embodiment serves only for illustration purpose and not by way of limitation. Modification will become evident to those skilled in the art which will fall within the scope of attached claims.

I claim:

1. Power generating and air conditioning system having an internal combustion engine, a vapor engine having a rotor inside and a refrigerant cycling circuit, said system comprising:

(a) a power generating refrigerant circuit including in series:
- a refrigerant pump;
- a receiver;
- a heat exchanger having at least two accumulating chambers disposed therein and connected in parallel with each other, each of said chambers having a check valve at its inlet to permit the entry of low pressure refrigerant from said receiver and each of said chambers having a release valve at its outlet to prohibit the exit of said refrigerant until it had reached a predetermined working pressure; and,
- a vapor engine disposed successively along the flow direction of the refrigerant and arranged in order by related piping to return said refrigerant to said refrigerant pump (b) an air conditioning cooling circuit having one end connected to the outlet side of said vapor engine and having the other end connected to the suction end of said refrigerant pump and operative to bypass a portion of said refrigerant from said power generating circuit to produce a cooling effect and then to return said refrigerant to said power generating circuit said cooling circuit including in series:
- condenser means;
- liquid storage means for storing the condensed refrigerant;
- evaporation means for evaporating said refrigerant and thereby absorbing heat from a space desired to be cooled (c) means for introducing waste heat of said internal combustion engine into said heat exchanger to elevate said refrigerant to a predetermined working pressure in said accumulating chambers;

(d) means for operating each of said accumulator check valves and each said accumulator release valves alternatively in sequence to release refrigerant accumulated at a working pressure alternatively from successive accumulating chambers to provide a substantially continuous flow of refrigerant to operate said vapor engine whereby the waste heat of said internal combustion engine is exchanged through said heat exchanger with said refrigerant inside said exchanger and said refrigerant is thereby elevated to a predetermined working pressure in said accumulating chambers and part of said refrigerant is released into said vapor engine to drive the rotor thereof through expansion of the refrigerant to generate power and part of said refrigerant is introduced to said cooling circuit to be condensed and evaporated to produce a cooling effect.

2. The system of claim 1 wherein means are provided for circulating said internal combustion engine cooling water in heat exchange relationship through said condenser of said cooling circuit to help condense said refrigerant therein.

3. Power generating and air conditioning system according to claim 1, wherein a check valve is provided at the suction side of the refrigerant pump in the power generating refrigerant circuit.

4. Power generating and air conditioning system according to claim 1, wherein said cooling circuit includes a flow control means at the inlet of the condenser and an expansion valve at the inlet side of the evaporator and a check valve at the outlet of the evaporator and the suction side of the refrigerant pump.

5. Power generating an air conditioning system according to claim 1, wherein means are provided in said heat exchanger for transferring heat to said refrigerant in said accumulators from the waste heat from the exhaust gas, the lubricating oil and cooling water of said internal combustion engine.

6. Power generating an air conditioning system according to claim 1, wherein means are provided for circulating a portion of the exhaust gases from said internal combustion engine around said vapor engine for transfer of heat thereto.

7. Power generating and air conditioning system according to claim 1, wherein the refrigerant pump is driven by the said internal combustion engine.

* * * * *